US008891986B2

(12) United States Patent
Kawaguchi et al.

(10) Patent No.: US 8,891,986 B2
(45) Date of Patent: Nov. 18, 2014

(54) IMAGE FORMING APPARATUS

(75) Inventors: Yuji Kawaguchi, Mishima (JP); Kentarou Kawata, Suntou-gun (JP); Takuya Kitamura, Numazu (JP); Takayuki Kanazawa, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 521 days.

(21) Appl. No.: 13/205,508

(22) Filed: Aug. 8, 2011

(65) Prior Publication Data

US 2012/0045230 A1 Feb. 23, 2012

(30) Foreign Application Priority Data

Aug. 20, 2010 (JP) ..... 2010-185089

(51) Int. Cl.

| | |
|---|---|
| ***G03G 15/00*** | (2006.01) |
| ***G03G 15/16*** | (2006.01) |
| ***G03G 15/02*** | (2006.01) |
| ***G03G 15/01*** | (2006.01) |

(52) U.S. Cl.

CPC .... *G03G 15/0157* (2013.01); *G03G 2215/0177* (2013.01); *G03G 15/0147* (2013.01)

USPC ..... 399/45; 399/66; 399/50

(58) Field of Classification Search

None

See application file for complete search history.

(56) References Cited

U.S. PATENT DOCUMENTS

| | | | | |
|---|---|---|---|---|
| 5,640,645 | A * | 6/1997 | Namekata et al. | 399/66 |
| 2008/0124124 | A1 * | 5/2008 | Ishida | 399/149 |

FOREIGN PATENT DOCUMENTS

| | | | |
|---|---|---|---|
| JP | 2000-010416 | A | 1/2000 |
| JP | 2003-057923 | A | 2/2003 |
| JP | 2009-116130 | A | 5/2009 |

* cited by examiner

*Primary Examiner* — Clayton E LaBalle
*Assistant Examiner* — Jas Sanghera
(74) *Attorney, Agent, or Firm* — Canon USA, Inc. IP Division

(57) ABSTRACT

A mode in which a toner image formed on an intermediate transfer belt passes through a primary transfer portion without a toner image being transferred from a photosensitive drum onto the intermediate transfer belt is provided. In the mode, an area of the photosensitive drum that passes through the primary transfer portion while the toner image is passing through the primary transfer portion is defined as a first area. When the first area passes through a charging position, a charging bias is adjusted so that the occurrence of an image defect is prevented.

6 Claims, 8 Drawing Sheets

POST-TRANSFER POTENTIAL ≤
ABSOLUTE VALUE OF CHARGING BIAS <
ELECTRICAL DISCHARGE START VOLTAGE

ABSOLUTE VALUE OF
CHARGING BIAS ≤
POST-TRANSFER POTENTIAL

IMAGE FORMING APPARATUS

BACKGROUND OF THE INVENTION

1. Field of the Invention

Embodiments of the present invention relate to electrophotographic image forming apparatus using a plurality of developing units.

2. Description of the Related Art

In general, existing image forming apparatuses employ an electrostatic recording method and an electrophotographic recording method. One of such methods is an intermediate transfer method. In an intermediate transfer method, a toner image is formed on a photosensitive drum. The toner image is primarily transferred onto an intermediate transfer member so as to overlap a previously transferred toner image in sequence and, thereafter, the toner images are secondarily transferred onto a transfer material at the same time. An intermediate transfer method has an advantage over a multiple transfer method in which toner images of individual colors are sequentially transferred from the photosensitive drum onto a transfer material in that image transfer may be stably performed onto a variety of transfer materials.

In image forming apparatuses that employ an intermediate transfer method, four color toner images, namely, yellow, magenta, cyan, and black toner images, formed on a photosensitive drum are sequentially primarily transferred onto an intermediate transfer member in the form of a belt or a drum. The four toner images transferred one on top of the other are finally secondarily transferred onto a transfer material in one go. However, since it is difficult to obtain a transfer efficiency of 100% when the toner image is secondarily transferred onto a transfer material, a small amount of toner remains on the intermediate transfer member after the toner image has been secondarily transferred. The toner remaining after secondary transfer is scraped off using a cleaning blade. Alternatively, the toner remaining after secondary transfer is recovered using a cleaning blade provided on a photosensitive drum and a simultaneous transfer and cleaning method (refer to, for example, Japanese Patent Laid-Open No. 2009-116130).

In apparatuses that perform secondary transfer after four color toner images has been transferred onto an intermediate transfer member, the operating condition for secondary transfer needs to be changed in order to efficiently perform the transfer when a special sheet, such as heavy paper, is used as a transfer material. For example, the speed of the intermediate transfer member and the speed of secondary transfer are reduced as compared with those for plain paper. In such a case, in order to prevent throughput degradation, an operation at a normal speed is performed until primary transfer is completed, and before the leading edge of a toner image formed on the intermediate transfer member reaches a secondary transfer portion, the speed of the intermediate transfer member is reduced.

Recently, in order to reduce the size of the image forming apparatus, some the image forming apparatuses have had a distance between a primary transfer portion and a secondary transfer portion that is smaller than the length of an image in the conveying direction. In such a case, when primary transfer of a toner image of a fourth color onto the intermediate transfer member is completed, the leading edge of the toner image has already passed through the secondary transfer portion. Accordingly, in order to perform secondary transfer after the speed has been changed, the image forming apparatus causes the formed toner image to pass through the primary transfer portion without performing transfer in the primary transfer portion. At that time, when the toner image formed on the intermediate transfer member passes through the primary transfer portion, scumming and reverse transfer may occur due to the electric field in the primary transfer portion. In order to prevent such a problem, when the toner image formed on the intermediate transfer member passes through the primary transfer portion, the electric field is reduced so as to be lower than that needed for image formation (refer to, for example, U.S. Pat. No. 5,640,645).

However, when the intermediate transfer member having a toner image formed thereon passes through the primary transfer portion, the toner on the intermediate transfer member may be reverse transferred onto the photosensitive drum. If the reverse transferred toner is not recovered by the cleaning unit of the photosensitive drum, the toner reaches a charging unit of the photosensitive drum. In the charging unit, the toner receives electrical discharge. Thereafter, the toner is transferred onto the intermediate transfer member again. Thus, an image defect, such as blotches or pitched dots, occurs. In existing technologies, reverse transfer may be prevented. However, existing technologies do not disclose prevention of an image defect caused by reverse transferred toner.

SUMMARY OF THE INVENTION

One disclosed aspect of the embodiments provides an image forming apparatus including an intermediate transfer member that has a toner image formed thereon and passes through a primary transfer portion and being capable of reducing an image defect by controlling a voltage applied to a charging unit.

According to an embodiment of the present invention, an image forming apparatus includes a rotatable image bearing member configured to bear a toner image, a charging member configured to charge the image bearing member, an intermediate transfer member onto which the toner image formed on the image bearing member is transferred, a primary transfer unit configured to primarily transfer the toner image that the image bearing member bears to the intermediate transfer member in a primary transfer portion, a secondary transfer unit configured to secondarily transfer the toner image transferred onto the intermediate transfer member onto a transfer object in a secondary transfer portion, and a control unit. A mode in which the toner image formed on the intermediate transfer member passes through the primary transfer portion without a toner image being transferred from the image bearing member onto the intermediate transfer member is provided. In the mode, an area of the image bearing member that passes through the primary transfer portion while the toner image is passing through the primary transfer portion is defined as a first area. The control unit controls a voltage applied to the charging member so that electrical discharge does not occur between the image bearing member and the charging member when the first area reaches a position of the charging member.

Further features of the embodiments will become apparent from the following description of exemplary embodiments with reference to the attached drawings.

DESCRIPTION OF THE EMBODIMENTS

First Embodiment

Exemplary embodiments of the present invention are described below with reference to the accompanying drawings. It should be noted that the dimensions, the materials, the shapes, and the relative positions of components described in the exemplary embodiments may be appropriately changed in accordance with the configuration and a variety of conditions of apparatuses according to one disclosed aspect of the embodiments. Therefore, the scope of the invention should not be construed as being limited by the components or their configuration as illustrated in the embodiments described below.

One disclosed feature of the embodiments may be described as a process which is usually depicted as a flowchart, a flow diagram, a timing diagram, a structure diagram, or a block diagram. Although a flowchart or a timing diagram may describe the operations or events as a sequential process, the operations may be performed, or the events may occur, in parallel or concurrently. In addition, the order of the operations or events may be re-arranged. A process is terminated when its operations are completed. A process may correspond to a method, a program, a procedure, a method of manufacturing or fabrication, a sequence of operations performed by an apparatus, a machine, or a logic circuit, etc.

Figure 1:
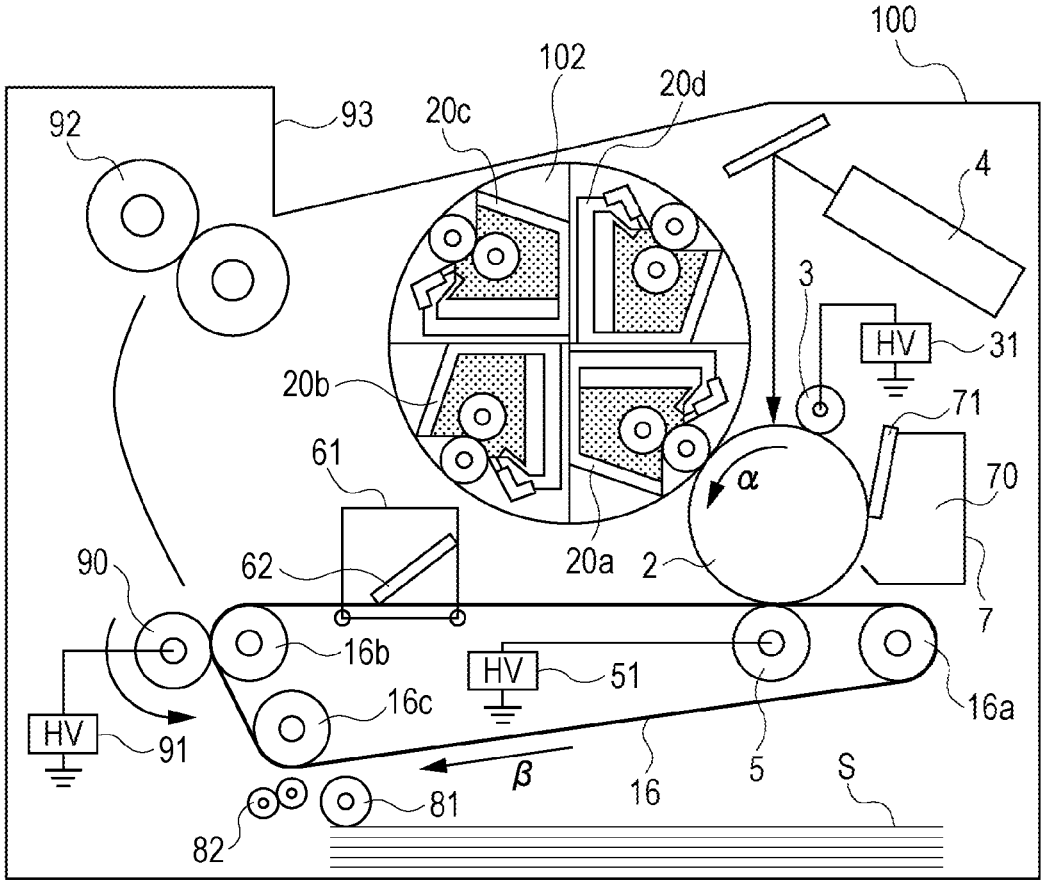
FIG. 1 is a schematic illustration of the configuration of an image forming apparatus according to a first embodiment of the present invention.

An image forming apparatus and a developing unit according to a first embodiment of the present invention are described with reference to FIG. 1. FIG. 1 is a schematic cross-sectional view of an image forming apparatus 100 according to the first embodiment of the present invention. In the present embodiment, the image forming apparatus is a color laser printer of a rotary type.

An image forming operation performed by an image forming unit is described first. The color laser printer includes a rotatable photosensitive drum 2 (an image bearing member). As shown in FIG. 1, the photosensitive drum 2 is rotated in a direction indicated by an arrow α and is uniformly charged by a charging roller 3 (a charging member). Thereafter, the photosensitive drum 2 is exposed to a laser beam emitted from a laser optical unit 4 (an exposure unit). In this way, an electrostatic latent image is formed on the surface of the photosensitive drum 2.

In addition, the color laser printer includes developing units 20*a* to 20*d* for the colors (yellow, magenta, cyan, and black) of developers. The developing units 20*a* to 20*d* supply developers to the electrostatic latent image formed on the surface of the photosensitive drum 2 and develops the electrostatic latent image. Each of the developing units 20*a* to 20*d* is integrally supported by a rotary 102 (a developing unit supporter) that is rotatable in a direction the same as the direction in which the photosensitive drum 2 rotates. Note that each of the developing units 20*a* to 20*d* may be removable from the rotary 102. In such a configuration, each of the developing units 20*a* to 20*d* may be refilled with a developer, and each of the developing units 20*a* to 20*d* may be maintained independently.

An electrostatic latent image is developed by, for example, the developing unit 20*a* for yellow and is visualized in the form of a toner image. In addition, before the electrostatic latent image is formed, the rotary 102 is driven using a drive transfer mechanism (not shown). Thus, the developing unit 20*a* for yellow is rotatingly moved to a position at which the developing unit 20*a* faces the photosensitive drum 2 (a development position). The visualized toner image formed on the photosensitive drum 2 is transferred onto an intermediate transfer belt 16 (an intermediate transfer member) using a transfer unit. The transfer unit includes a primary transfer roller 5 and a high voltage power supply 51. Residual toner remaining on the photosensitive drum 2 after primary transfer is scraped off by a cleaning blade 71 (a cleaning member) and is recovered into a waste-toner container 70. The photosensitive drum 2 subjected to the cleaning operation repeats the above-described operation and forms an image. After each of the developing units 20 is located at the development position, development and primary transfer are performed for each of the magenta, cyan, and black colors as for the yellow color. As a result, images formed from the developers for four colors are transferred onto the intermediate transfer belt 16 so as to overlap one another. The toner transferred onto the intermediate transfer belt 16 is secondarily transferred onto a transfer material S conveyed into a secondary transfer portion.

Secondary transfer is performed by a secondary transfer unit including a secondary transfer roller 90 and a high voltage power supply 91. The transfer material S subjected to a transfer operation is conveyed to a fusing unit 92. In the fusing unit 92, heat and pressure are applied to the transfer material S. Thus, the toner image is fixed onto the transfer material S. In this way, an image is formed on the transfer material S. The transfer material S is ejected from the fusing unit 92 onto a paper ejecting unit 93 disposed on an upper cover outside the apparatus.

However, in a secondary transfer nip, some of the toner that is not secondarily transferred onto the transfer material S and remains on the intermediate transfer belt 16 after secondary transfer exist. Most of the toner is recovered by a transfer cleaning unit 61 disposed on the intermediate transfer belt 16. However, residual toner that still remains after the cleaning operation has been performed and that reaches the primary transfer portion is recovered by the cleaning blade 71 located downstream of the photosensitive drum 2.

An image forming operation according to the present embodiment is described with reference to FIG. 1. The photosensitive drum 2 is rotated in a direction indicated by the arrow α shown in FIG. 1 in synchronization with the rotation of the intermediate transfer belt 16. At that time, the secondary transfer roller 90 is moved away from the intermediate transfer belt 16. A bias of −1100 V is applied from a high voltage power supply 31 to the charging roller 3. In this way, the surface of the photosensitive drum 2 is uniformly charged to −570 V. In addition, a light beam is emitted from the laser optical unit 4 to the photosensitive drum 2, and an electrostatic latent image is formed on the photosensitive drum 2. According to the present embodiment, the external diameter of the photosensitive drum 2 is set to Φ30, and the length of the intermediate transfer belt 16 is set to 377 cm.

Before the electrostatic latent image is formed, the developing units 20 are driven by a drive transfer mechanism (not shown), and the electrostatic latent image is visualized as a toner image on the photosensitive drum 2. During a development operation, a bias of −300 V having the same polarity as that of the negatively charged toner (negative toner) in the developing units 20 is applied from a high voltage power supply (not shown) to a developing roller 22. The difference in potential between the developing roller 22 and the photosensitive drum 2 generates an electric field that causes the toner to move from the developing roller 22 to the photosensitive drum 2. In this way, the toner is deposited onto the electrostatic latent image formed on the photosensitive drum 2, and the electrostatic latent image is developed. Subsequently, a primary transfer bias of 800 V is applied from the high voltage power supply 51 to the primary transfer roller 5 disposed inside the loop of the intermediate transfer belt 16, and the toner image formed on the photosensitive drum 2 is primarily transferred onto the intermediate transfer belt 16. As described above, the electrostatic latent image is formed, developed, and primarily transferred in sequence. Thus, a toner image is formed on the intermediate transfer belt 16. At that time, only monochrome toner may be transferred onto the intermediate transfer belt 16. Alternatively, toner of four full colors may be transferred onto the intermediate transfer belt 16.

Figure 2:
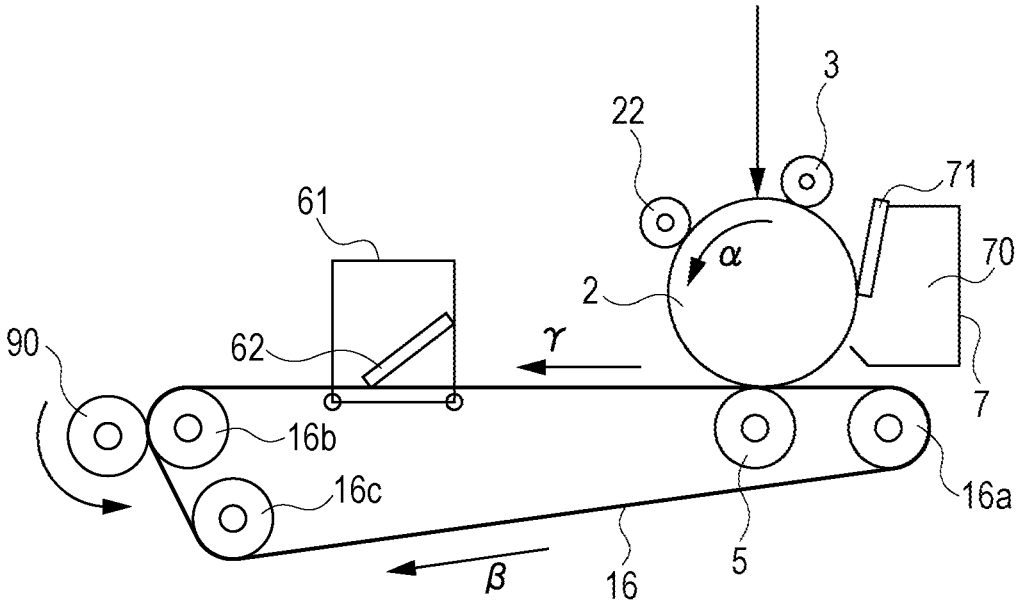
FIG. 2 is a schematic illustration of a primary transfer portion of the image forming apparatus according to the first embodiment.

The structure of the intermediate transfer belt 16 and the secondary transfer unit are described in detail below. FIG. 2 illustrates the intermediate transfer belt 16 and the vicinity thereof in detail. Note that for simplicity, the developing units 20 and the rotary 102 are not shown, and only the developing roller 22 that faces the photosensitive drum 2 is shown. The intermediate transfer belt 16 is supported around a plurality of rollers 16*a*, 16*b*, and 16*c* beneath the photosensitive drum 2. The intermediate transfer belt 16 is rotated in a direction indicated by an arrow β. The primary transfer roller 5 is disposed in the primary transfer portion in which the photosensitive drum 2 is in pressure contact with the intermediate transfer belt 16 so as to nip the intermediate transfer belt 16 with the photosensitive drum 2. For the roller 16*b* which supports the intermediate transfer belt 16, the secondary transfer roller 90 is disposed so as to nip the intermediate transfer belt 16 with the roller 16*b*. The secondary transfer roller 90 may be in contact with the intermediate transfer belt 16 and may be moved away from the intermediate transfer belt 16. The roller 16*b* is referred to as a secondary transfer counter roller for the secondary transfer roller 90. The position at which the secondary transfer roller 90 is in contact with the intermediate transfer belt 16 and is moved away from the intermediate transfer belt 16 is referred to as a "secondary transfer portion".

At a time when the transfer material S reaches the secondary transfer portion, the secondary transfer roller 90 enters a contact mode in which the secondary transfer roller 90 is in contact with the intermediate transfer belt 16 by a contact/noncontact control mechanism. When the secondary transfer roller 90 enters a contact mode, a voltage of 1500 V is applied to the secondary transfer roller 90 by the high voltage power supply 91 as a secondary transfer bias. Thus, the above-described toner images formed on the intermediate transfer belt 16 are secondarily transferred onto the surface of the conveyed transfer material S in one go.

The transfer material S is in the form of one of sheets that is separated sheet by sheet by a paper feed roller 81. The transfer material S is fed to a pair of registration rollers 82. The pair of registration rollers 82 delivers the fed transfer material S to a secondary transfer nip formed by the secondary transfer roller 90 and the roller 16*b* via the intermediate transfer belt 16.

The transfer cleaning unit 61 is disposed downstream of the secondary transfer portion in a direction in which the intermediate transfer belt 16 moves. A blade 62 of the transfer cleaning unit 61 is in contact with the intermediate transfer belt 16 so as to scrape off toner deposited on the intermediate transfer belt 16. Similarly, for the photosensitive drum 2, a photosensitive member cleaning unit 7 is disposed downstream of the primary transfer portion in a direction in which the photosensitive drum 2 moves. The transfer cleaning unit 61 is in contact with the photosensitive drum 2 so that the cleaning blade 71 of the photosensitive member cleaning unit 7 scrapes off toner deposited on the photosensitive drum 2. A central processing unit (CPU) serves as a control unit, which controls a primary transfer bias applied to the primary transfer roller 5, a secondary transfer bias applied to the secondary transfer roller 90, and a charging bias applied to the charging roller 3.

The case in which a special sheet is used as the transfer material S in secondary transfer performed after toner images of four colors has been transferred onto the intermediate transfer belt 16 is described below. Examples of the special sheet include a heavy paper sheet having a thickness greater than that of a plain paper sheet, such as a postcard, an OHP sheet, and a paper sheet having a special shape, such as an envelope. When a heavy paper sheet is used, the speeds of the intermediate transfer belt 16, the secondary transfer roller 90, and the fusing unit 92 need to be decreased as compared with the speeds used when toner images are transferred onto a plain paper sheet in order to efficiently perform secondary transfer and heat fixing.

In addition, when a special sheet is used, a user may select one of print modes in order to select a speed appropriate for the type of sheet. For example, a mode selection unit (an operation panel) is provided in order for the user to select one of print modes. If a mode for using a special sheet is selected by a user using the operation panel, the intermediate transfer belt 16 is rotated five revolutions, as described below. In this way, the conditions optimum for transfer and fixing in accordance with the type of sheet may be set. Alternatively, instead of a user selecting a print mode, a media sensor (a transfer material detecting unit) that detects the type of transfer material may be provided, and the control unit may automatically select one of the modes in accordance with the result of detection performed by the media sensor. For example, if the media sensor determines that a heavy paper sheet is used, the intermediate transfer belt 16 may be rotated five revolutions.

According to the present embodiment, when a special sheet is used and if primary transfer is performed, a speed of the intermediate transfer belt 16 that is the same as the speed used when toner images are transferred onto a plain paper sheet is employed (1/1 of the speed). However, when secondary transfer is performed, the speed is switched to 2/5 of the speed used when toner images are transferred onto a plain paper sheet. In this way, the transferability of secondary transfer is increased. Note that the speed of the intermediate transfer member when a plain paper sheet is used is set to about 102 mm/sec. In such a case, since the operations performed prior to primary transfer are the same as those for a plain paper sheet, the speed is switched with the intermediate transfer belt 16 having a toner image thereon immediately before second transfer starts.

At that time, if the length of the toner image in the conveying direction is larger than a distance between the primary transfer portion and the secondary transfer portion, the leading edge of the image passes beyond the secondary transfer portion when primary transfer of a toner image of a black color (a fourth color) onto the intermediate transfer belt 16 is completed. Accordingly, in order to perform secondary transfer after the speed has been changed, the toner image formed on the intermediate transfer belt 16 needs to pass through the primary transfer portion again. Note that when transfer of toner images of four colors onto the intermediate transfer member is completed, the intermediate transfer member is rotated four revolutions. Thereafter, the speed after secondary transfer has started is decreased. Thus, the intermediate transfer member having a toner image thereon passes through the primary transfer portion again in the fifth revolution of the intermediate transfer member. Accordingly, in the fifth revolution, the intermediate transfer member having the toner image thereon passes through the primary transfer portion without a toner image being transferred from the photosensitive drum thereonto.

When the fifth revolution of the intermediate transfer belt 16 is started and if a charging bias and a primary transfer bias having levels that are used for image formation are applied, a difference in potential between the intermediate transfer belt 16 and the photosensitive drum 2 in the primary transfer portion is too large. Therefore, during the fifth revolution of the intermediate transfer belt 16, toner that is deposited on the intermediate transfer belt 16 and that has a positive charge, which is an opposite charge, that is, positive toner, is re-transferred onto the photosensitive drum 2 due to the electric field. Such positive toner is generated when the toner is subjected to electrical discharge due to primary transfer and, thus, is oppositely charged. In addition, toner that is deposited on the intermediate transfer belt 16 and that has a weak negative component may be returned to the surface of the photosensitive drum 2 if the difference in polarity is large.

In general, re-transferred toner is recovered by the cleaning blade 71 for the photosensitive drum 2. However, some toner may still remain on the photosensitive drum 2 after the cleaning operation has been completed. As a result, the toner that passes through the cleaning blade 71 reaches the charging roller 3 upon rotation of the photosensitive drum 2. The re-transferred toner (the positive toner) that has reached the charging roller 3 receives electrical discharge from the charging roller 3. Thus, the toner is negatively charged again. The negative toner reaches the primary transfer portion, where the negative toner is primarily transferred onto the intermediate transfer belt 16 that is positively charged again. If the toner is re-transferred in primary transfer, blotches appear in an image because toner particles that have passed through the cleaning blade are directly printed in an image. In particular, toner frequently passes through the cleaning blade along the irregularities formed on the surface of a photosensitive drum. The irregularities are formed on the surface of a photosensitive drum if the surface of the photosensitive drum is damaged or a free external additive for toner is deposited on a photosensitive drum in the form of fused deposition.

Figure 3A:
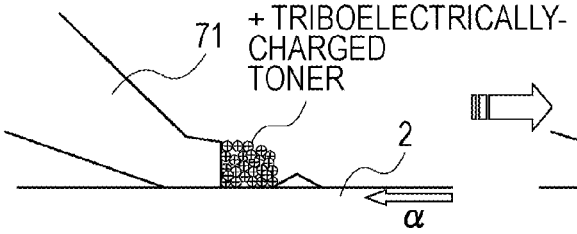
FIGS. 3A to 3E illustrate the processes occurring during a fifth revolution of an intermediate transfer belt of an existing image forming apparatus.
Figure 3B:
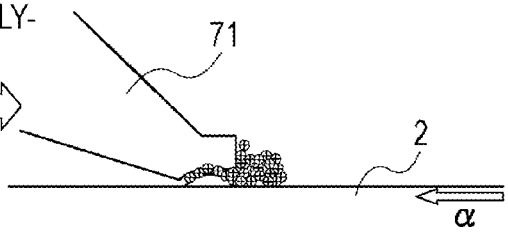
Figure 3C:
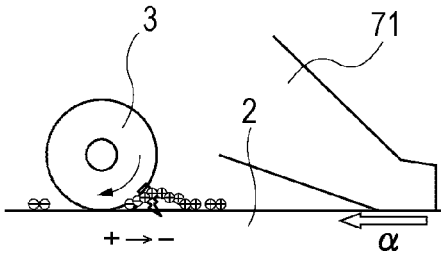
Figure 3D:
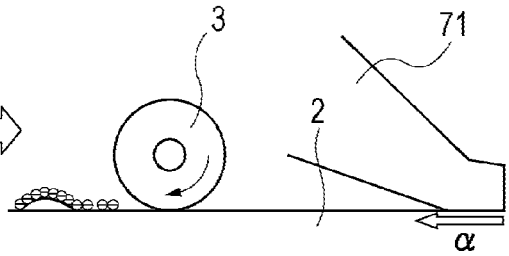
Figure 3E:
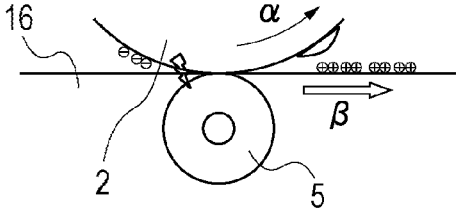

The process in which toner passes through the cleaning blade 71 is estimated as shown in FIGS. 3A to 3E. That is, as shown in FIG. 3A, re-transferred toner with a positive charge enters the cleaning blade 71. However, as shown in FIG. 3B, if the photosensitive drum 2 has irregularities, such as fused deposition, formed thereon, the cleaning blade 71 may not exactly follow the surface of the photosensitive drum 2 and, therefore, the toner passes through the cleaning blade 71. The toner that has passed through the cleaning blade 71 reaches the charging roller 3, where the positive toner is negatively charged again due to electrical discharge (refer to FIGS. 3C and 3D). Subsequently, the toner is re-transferred in the primary transfer portion (refer to FIG. 3E).

The occurrence of such a phenomenon results from the photosensitive drum 2 that is charged using a charging bias having the same level as in image formation when the toner image remaining on the intermediate transfer belt 16 after secondary transfer has been completed enters the primary transfer portion. At that time, if a difference in potential between the primary transfer bias and the surface of the photosensitive drum 2 (hereinafter referred to as "primary transfer contrast") is large, it is disadvantageous in terms of re-transfer.

Figure 4:
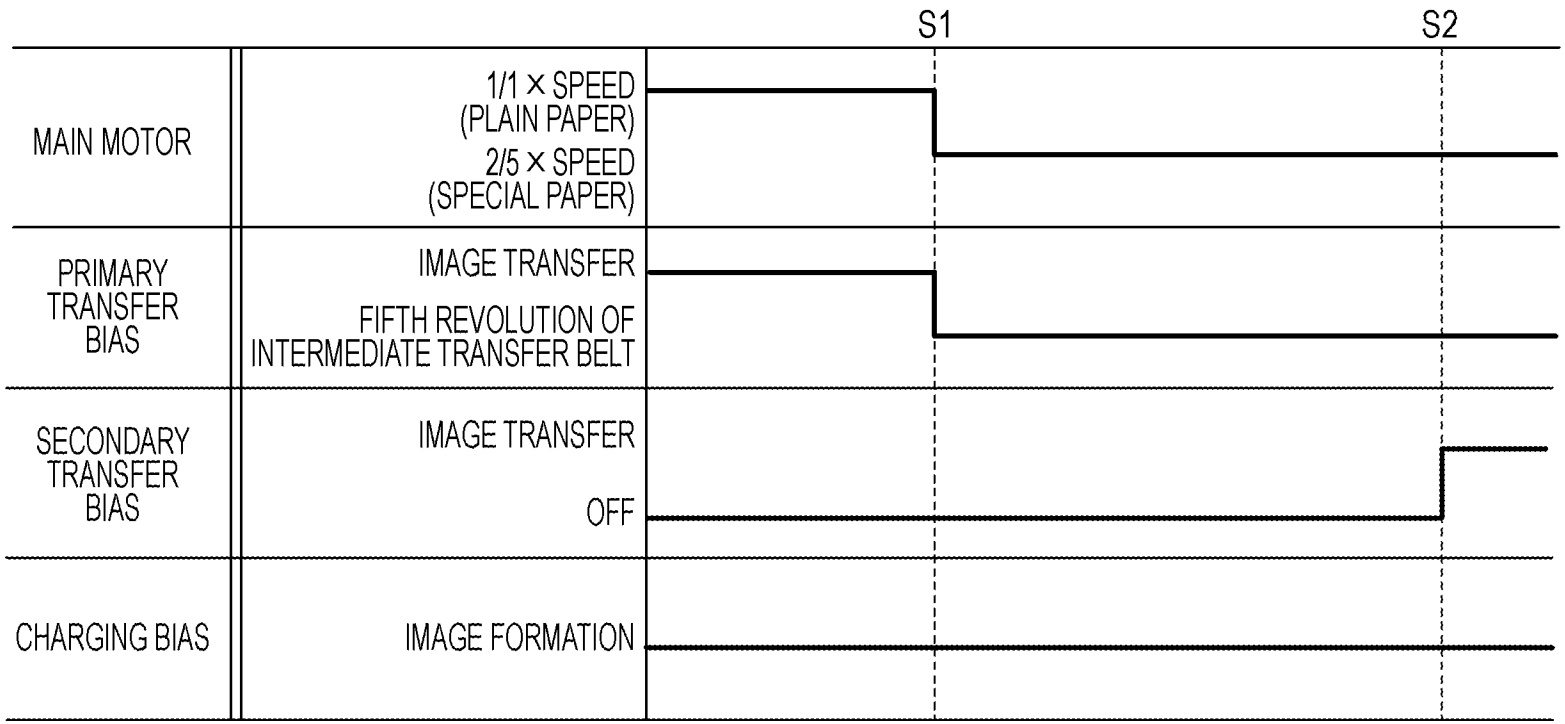
FIG. 4 is a timing diagram of bias application during a fifth revolution of the intermediate transfer belt of an existing image forming apparatus.

FIG. 4 is a timing diagram of an operation performed during a fifth revolution of the intermediate transfer belt 16 of an existing image forming apparatus. In an existing image forming apparatus, at a time S1, a print operation for a black color (a fourth color) is completed. That is, primary transfer of a black toner image (for the fourth color) is completed. In addition, at the time S1, the speed of the intermediate transfer belt 16 is changed from 1/1x to 2/5x using a main motor. Furthermore, the primary transfer bias is changed to 360 V, which is a primary transfer bias for special paper (2/5x). Still furthermore, in order to perform secondary transfer, the secondary transfer roller 90 is brought into contact with the intermediate transfer belt 16. At a time S2 at which a toner image is secondarily transferred from the intermediate transfer belt 16, a secondary transfer bias is applied. During such series of operations, a charging bias having the same level as in image formation is applied to the photosensitive drum 2. In addition, since according to the present embodiment, a pre-exposure unit that decreases the surface potential of the photosensitive drum 2 is not provided, electrical charge remains on the surface of the photosensitive drum 2. For this reason, the primary transfer contrast is negligibly decreased.

Thus, according to the present embodiment, in order to prevent toner particles that have passed through a cleaning blade from being re-charged, a charging bias applied during a fifth revolution of the intermediate transfer belt 16 is decreased so as to have a level lower than an electrical discharge start voltage. In this way, electrical discharge between the intermediate transfer belt 16 and the photosensitive drum 2 may be prevented. That is, a charging bias that does not charge the toner that has passed through the cleaning blade due to electrical discharge is selected. According to the present embodiment, the electrical discharge start voltage is about −550 V. By decreasing the charging bias to a value lower than the electrical discharge start voltage, electrical discharge may be prevented and, therefore, the absolute value of the surface potential of the photosensitive drum 2 may be decreased. Note that the electrical discharge start voltage of −550 V indicates the electrical discharge start voltage obtained when the potential of the image bearing member is 0 V. Whether or not electrical discharge between the charging roller 3 and the photosensitive drum 2 occurs is determined by the original potential of the photosensitive drum 2. For example, when the potential of the photosensitive drum 2 before the photosensitive drum 2 is charged is −200 V and if a negative voltage having an absolute value that is greater than the absolute value of −750 V (=−200 V+(−550 V)) is not applied to the charging roller 3, electrical discharge does not occur.

TABLE 1 shows the primary transfer contrast and the result of evaluation of an image when a charging bias during the fifth revolution of the intermediate transfer belt 16 is changed. At that time, the primary transfer bias was 360 V during the fifth revolution of the intermediate transfer belt 16, and the charging bias applied to the photosensitive drum 2 was −1100 V in the case of a prior art example. Therefore, the potential of a non-exposure portion of the photosensitive drum 2 (the potential of a white portion) was −570 V and the primary transfer contrast was 930 V when a toner image reached the primary transfer portion during the fifth revolution. In an embodiment 1-1, a bias that is weaker than the electrical discharge start voltage was selected. More specifically, a bias of −300 V was selected. Accordingly, the potential of a non-exposure portion of the photosensitive drum 2 (the potential of a white portion) was 0 V and the primary transfer contrast was 360 V when a toner image reached the primary transfer portion during the fifth revolution of the intermediate transfer belt 16. In the evaluation, when blotches are found in an image and if the quality is significantly degraded, "xx" is given. If blotches are found in an image, "x" is given. If no blotches are found in an image, "O" is given.

TABLE 1

| | Prior Art Example | Embodiment 1-1 |
|---|---|---|
| Primary Transfer Bias (V) | 360 | 360 |
| Charging Bias (V) | −1100 | −300 |
| Surface Potential of photosensitive drum (V) | −570 | 0 |
| Primary Transfer Contrast (V) | 930 | 360 |
| Blotches in Image | x | ○ |

As may be seen from the above-described result, when a charging bias having a level that is the same as the level causing an electrical discharge in image formation is applied, toner that has passed through the cleaning blade is found in the image. In contrast, when the charging bias is set to a bias weaker than the electrical discharge start voltage, toner that has passed through the cleaning blade may be prevented. From this result, it is estimated that if the charging bias is set to a bias that does not cause an electrical discharge, the primary transfer contrast is decreased and, therefore, the amount of toner that is re-transferred is reduced. In addition, even when re-transferred toner exists, the re-transferred toner is not charged by an electrical discharge from the charging roller 3. Therefore, the toner is not primarily transferred again and does not appear in an image. As a result, the occurrence of blotches in an image may be prevented.

Subsequently, in order to measure the effect of electrical discharge from the charging roller on a charge of toner, the following experiment was conducted. First, the area of the photosensitive drum 2 when the intermediate transfer belt 16 that has a toner image formed thereon passes through the primary transfer portion in a fifth revolution of the intermediate transfer belt 16 is referred to as a "first area". The condition of the primary transfer contrast of the prior art example when the first area was located in the primary transfer portion was made the same as that of a comparative example. That is, the amounts of re-transferred toner were made substantially the same. More specifically, the primary transfer contrast was set to 930 V. Thereafter, the charging biases applied to the charging rollers 3 when the first area reaches the position of the charging roller 3 were changed. The comparative example at that time is referred to as a "first comparative example". From a comparison of the prior art example and the first comparative example, the effects of the amounts of re-transferred toner may be obtained.

In the embodiment 1-1 and an embodiment 1-2, a bias applied to the charging roller 3 was set to −300 V so that electrical discharge did not occur between the photosensitive drum 2 and the charging roller 3.

In contrast, like the prior art example, in the subsequent comparative example, a bias applied to the charging roller 3 was set to −1100 V so that electrical discharge occurred between the photosensitive drum 2 and the charging roller 3. From the above-described comparison, the effect of charged toner may be obtained. Subsequently, in the embodiment 1-1, the embodiment 1-2, and the comparative example, the primary transfer contrasts were set to 360 V, 930 V, and 1500 V, respectively, when the first area that has passed through the charging roller 3 reached the primary transfer portion again. At that time, it was determined whether blotches appeared in an image. The results are shown in the following table.

TABLE 2

| | Prior Art Example | Embodiment 1-1 | Embodiment 1-2 | Comparative Example |
|---|---|---|---|---|
| Primary Transfer Bias (V) | 360 | 360 | 930 | 930 |
| Charging Bias (V) | −1100 | −300 | −300 | −1100 |
| Surface Potential of photosensitive drum (V) | −570 | 0 | 0 | −570 |
| Primary Transfer Contrast (V) | 930 | 360 | 930 | 1500 |
| Blotches in Image | x | ○ | ○ | xx |

As may be seen from the results in the embodiments 1-1 and 1-2, the occurrence of blotches in an image may be prevented in both embodiments. This is because second electrical discharge is prevented for the toner. However, in the embodiment 1-2 in which the primary transfer bias is high, the amount of re-transferred toner in the fifth revolution is large. Thus, the level of quality of the printed image is disadvantageously decreased. Therefore, in order to effectively prevent the occurrence of blotches, it is preferable to select a charging bias that does not cause electrical discharge and reduce the primary transfer contrast.

As may be seen from the above-described results, by decreasing the primary transfer contrast, the amount of re-transferred toner may be reduced. Note that even when the primary transfer contrast is decreased, toner may be re-transferred and the toner may pass through the cleaning blade. Even in such a case, a bias that does not cause electrical discharge between the charging roller 3 and the photosensitive drum 2 is applied to the charging roller 3 when the area having re-transferred toner therein (the first area) is located at the position of the charging roller 3. In this way, the re-transferred toner may still remain positive. Therefore, the toner is not re-transferred onto the intermediate transfer belt in the primary transfer portion and, thus, blotches do not appear in an image. Note that the re-transferred toner that is not primarily transferred is cleaned by a cleaning unit that scrapes off toner and, therefore, an adverse effect of the re-transferred toner may be prevented.

Figure 5:
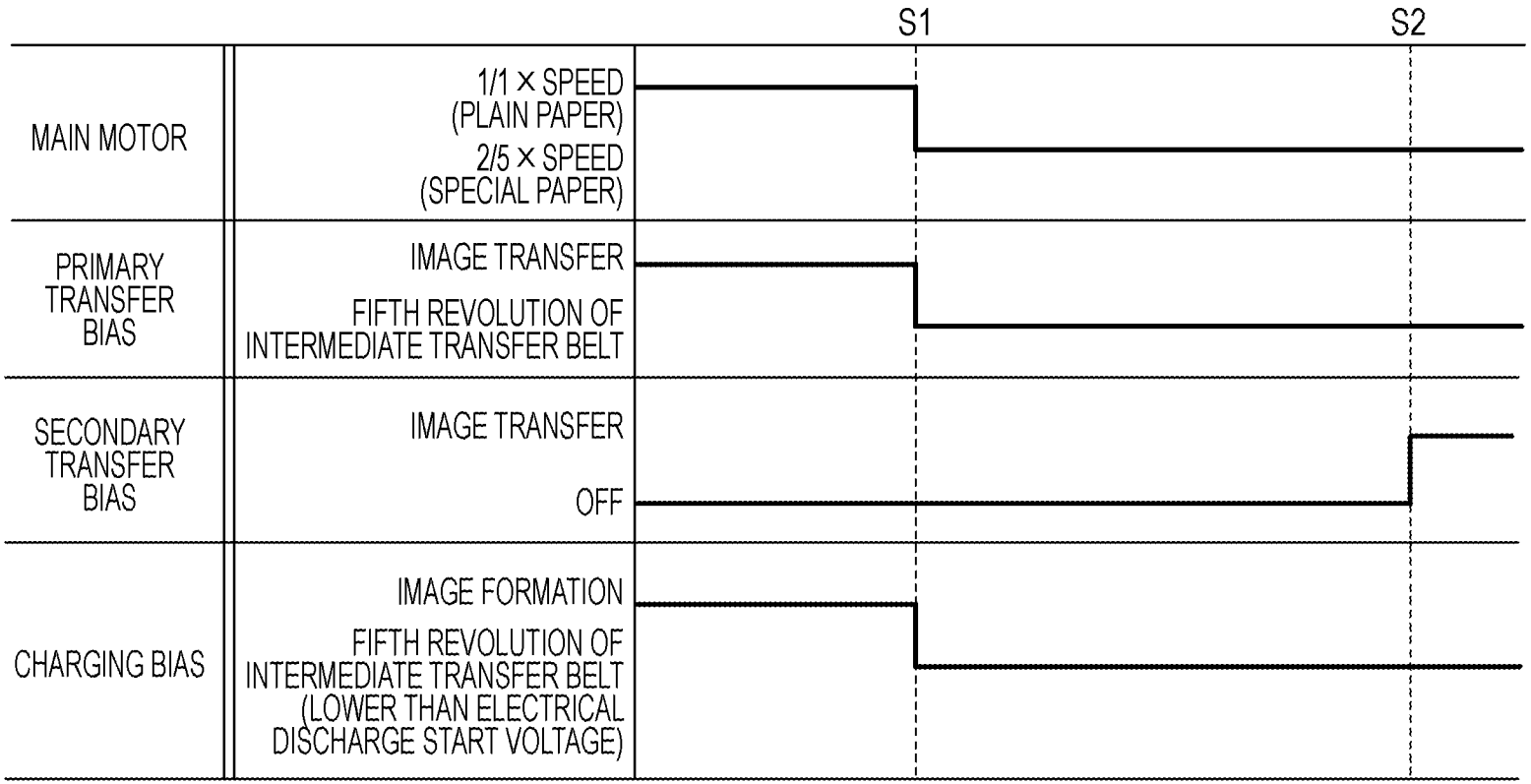
FIG. 5 is a timing diagram of bias application during a fifth revolution of the intermediate transfer belt according to the first embodiment.

The timing at which the charging bias is applied according to the first embodiment is described next. According to the first embodiment, as described above, in order not to charge the re-transferred toner by electrical discharge, it is effective to set the charging bias applied to the charging roller 3 to a value lower than the electrical discharge start voltage. The timing diagram at that time is shown in FIG. 5. As illustrated in FIG. 5, a point in time at which the charging bias is set to a value lower than the electrical discharge start voltage is immediately after primary transfer of black toner (toner of the fourth color) has been completed (i.e., a time S1). More specifically, at the time S1, the charging bias is changed from −1100 V to −300 V. By changing the charging voltage at that time, re-transferred toner is not charged by the charging roller even when the toner that has passed through the secondary transfer portion is re-transferred through primary transfer and is not cleaned by the cleaning blade 71. In addition, since the surface potential of the photosensitive drum 2 starts attenuating by the time the re-transferred toner reaches the primary transfer portion again, the primary transfer contrast decreases. At that time, it is desirable that a distance from the leading edge of the toner image that has passed through the secondary transfer portion to the primary transfer portion be longer than a distance from the charging roller to the primary transfer portion. In this way, before the leading edge of the toner image that has passed through the secondary transfer portion reaches the primary transfer portion, the area of the photosensitive drum 2 that has passed beyond the position of the charging roller may reach the primary transfer portion when the charging bias lower than or equal to the electrical discharge start voltage is applied.

As may be seen from the results shown in TABLE 1, when a charging bias that does not cause electrical discharge is used, the surface potential of the photosensitive drum 2 falls to about 0 V by the time the toner passes through the primary transfer portion and reaches the primary transfer portion again on rotation of the photosensitive drum 2. Accordingly, the primary transfer contrast obtained when the toner image in the fifth revolution reaches the primary transfer portion may be decreased and, therefore, re-transfer of toner starting from the leading edge of the image may be prevented.

In addition, at the time S1, the transfer bias is changed to the primary transfer bias for special paper (2/5x speed) in the fifth revolution of the intermediate transfer belt 16. More specifically, the transfer bias is set to 360 V. Subsequently, after the trailing edge of the toner image on the intermediate transfer belt 16 in the fifth revolution has passed through the secondary transfer portion and after the leading edge of the toner image has passed through the primary transfer portion and before the leading edge reaches the secondary transfer portion, the secondary transfer roller 90 is brought into contact with the intermediate transfer belt 16 and applies a secondary transfer bias to the intermediate transfer belt 16 (at a time S2).

By employing such a technique, re-charging of re-transferred toner due to electrical discharge may be prevented. In addition, the occurrence of re-transfer of toner in the fifth revolution of the intermediate transfer belt 16 may be prevented. As a result, an image defect caused by toner fusion on a drum may be reduced.

Second Embodiment

In the second embodiment, the same numbering will be used in referring to the members and parts of the image forming apparatus as are utilized above in describing the first embodiment, and descriptions thereof are not repeated. It should be noted that the dimensions, the materials, the shapes, and the relative positions of components described in the present embodiment may be appropriately changed in accordance with the configuration and a variety of conditions of apparatuses according to one disclosed aspect of the embodiments. Therefore, the scope of the invention should not be construed as being limited by the parts or their configuration.

The first embodiment has been described with reference to a technique in which by setting the charging bias applied to the charging roller 3 to a bias that is weaker than the electrical discharge start voltage and that does not cause electrical discharge, toner that has passed through the cleaning blade 71 is not recharged and, thus, toner re-transferred from the intermediate transfer belt 16 is recovered without being subjected to primary transfer again.

Figure 6A:
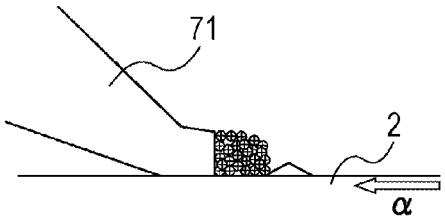
FIGS. 6A to 6D illustrate the processes occurring during a fifth revolution of an intermediate transfer belt according to the first embodiment and a second embodiment of the present invention.
Figure 6B:
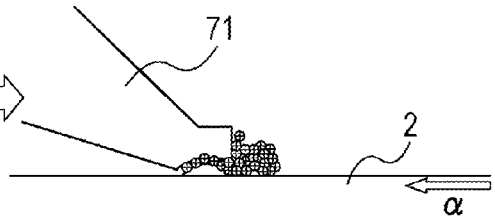
Figure 6C:
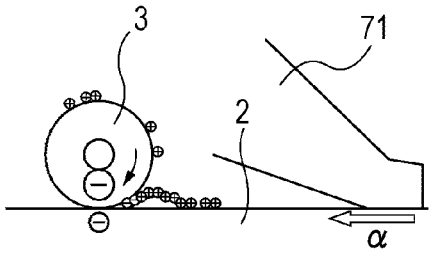
Figure 6D:
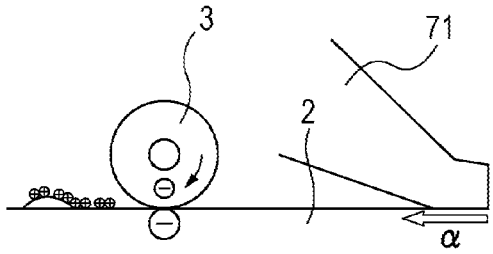

However, although toner that has passed through the cleaning blade 71 is not recharged and is recovered, all of toner may not be always recovered. Thus, toner that has passed through the cleaning blade 71 still remains. In such a case, the toner that has passed through the cleaning blade 71 may be electrically attracted by the charging roller 3 depending on the surface potential of the photosensitive drum 2 and may contaminate the charging roller 3. To prevent such contamination, a member that cleans the charging roller 3 needs to be additionally provided. If the charging roller 3 is contaminated, the charging bias may be changed by a contaminated portion and, therefore, vertical streakings may appear in an image. FIGS. 6A to 6D illustrate a phenomenon in which toner particles are electrically attracted by the charging roller 3. As shown in FIGS. 6A and 6B, toner that has passed through the cleaning blade 71 reaches the charging roller 3. As described in the first embodiment, by setting the charging bias to a bias level that does not cause electrical discharge, re-charge of the toner that has passed through the cleaning blade 71 may be prevented. However, as shown in FIG. 6C, if the surface potential of the photosensitive drum 2 is more positively charged than the bias applied by the charging roller 3, the toner that does not receive the electrical discharge is attracted by the charging roller (e.g., the bias applied by the charging roller 3=−400 V and the surface potential of the photosensitive drum 2=−300 V).

As described in the first embodiment, in order to form an image, the potential of a white portion of the photosensitive drum 2 is uniformly set to −570 V, and the potential of a black portion of the photosensitive drum 2 is uniformly set to −100 V through laser beam exposure. Note that a white portion is a non-image portion and a non-exposure portion. A black portion is an image portion and an exposure portion. When the surface of the photosensitive drum 2 enters the primary transfer portion after a developing operation has been performed by the developing unit 20, the above-described surface potentials are generally maintained although the potentials are slightly attenuated. However, after primary transfer has been performed, the surface potentials are slightly decreased (towards a positive potential), since the surface receives positive electrical discharge. The level of the decrease varies with the level of the primary transfer bias. In contrast, the toner re-transferred from the intermediate transfer belt 16 is positive toner on the intermediate transfer belt 16. Accordingly, depending on the surface potential of the photosensitive drum 2 after primary transfer (hereinafter referred to as a "post-transfer potential"), the toner may be attracted towards the charging roller 3 having a bias that does not cause electrical discharge. Therefore, by setting the bias applied to the charging roller 3 to a bias having a value less than or equal to the absolute value of the post-transfer potential, toner is not moved towards the charging roller 3 (refer to FIG. 6D). That is, by adjusting the charging bias, re-charge of toner re-transferred from the intermediate transfer belt 16 may be prevented and the need for an additional member is eliminated. In addition, contamination of the charging roller 3 may be prevented.

In order to evaluate this technique, the post-transfer potentials of a white portion and a black portion were actually measured. The post-transfer potentials were measured by connecting a probe to an electrostatic voltmeter (available from Trek Japan Co., Ltd.). A probe for measuring the surface potential was set downstream of the photosensitive drum 2 in a direction perpendicular to the photosensitive drum 2. The distance between the photosensitive drum 2 and the probe is set to 5 mm. The diameter of the opening of a detection unit was 0.5 mm. The surface potential of the photosensitive drum 2 in a white portion was set to −570 V, and the surface potential of the photosensitive drum 2 in a black portion was set to −100 V. By varying the primary transfer bias, the surface potentials were measured. The results of the measurement are shown in TABLEs 3A and 3B. TABLE 3A shows the post-transfer potentials of the white portion, and TABLE 3B shows the post-transfer potentials of the black portion.

TABLE 3A

| Primary Transfer Bias (V) | 250 | 400 | 550 | 700 | 800 | 950 | 1110 | 1250 | 1380 | 1450 |
|---|---|---|---|---|---|---|---|---|---|---|
| post-transfer Potential (V) | 570 | 530 | 460 | 400 | 320 | 230 | 180 | 100 | 20 | 0 |

TABLE 3B

| Primary Transfer Bias (V) | 1110 | 1250 | 1380 |
|---|---|---|---|
| post-transfer Potential (V) | 90 | 45 | 0 |

In the second embodiment, the range of the primary transfer bias applied when image formation is actually performed is set to a range from 500 V to 1200 V, although it depends on the use environment. Accordingly, in the second embodiment, the range of the post-transfer potential of a white portion is a range from about −450 V to about −150 V, and the range of the post-transfer potential of a black portion is a range from about −100 V to about −60 V.

As described above, according to the second embodiment, it is desirable that the bias applied to the charging roller 3 in the fifth revolution of the intermediate transfer belt 16 be set to a value less than or equal to the post-transfer potential shown in TABLEs 3A and 3B and, in particular, a value less than or equal to the post-transfer potential of a black portion. In an actual application, a table of the post-transfer potentials may be installed in an image forming apparatus, and a bias applied to the charging roller 3 may be selected from the table in accordance with the use environment and the primary transfer bias. Alternatively, a unit for measuring the post-transfer potential may be provided between the photosensitive drum 2 and the charging roller 3.

Third Embodiment

In the second embodiment, when the intermediate transfer belt 16 requires an operation for the fifth revolution thereof, the charging bias is decreased so as to be lower than the post-transfer potential of the photosensitive drum 2. In this way, electrical discharge may be prevented and, therefore, the occurrence of an image defect may be prevented.

Accordingly, if such a relationship is satisfied, a bias applied to the charging roller 3 is not necessarily needed. When it was examined whether toner that has passed through the cleaning blade appears in an image in the case where, as in the first embodiment, the charging bias is not applied, an image defect did not occur. Alternatively, a positive bias having such a level that does not cause electrical discharge may be applied to the charging roller 3.

Fourth Embodiment

In the first embodiment, a blade is used for the transfer cleaning unit 61. Instead of using a blade, a simultaneous transfer and cleaning method may be employed. The simultaneous transfer and cleaning method is briefly described below with reference to FIG. 7.

In the simultaneous transfer and cleaning method, residual toner remaining after secondary transfer is charged with a positive polarity that is opposite to the charging polarity of the toner by using a charging roller disposed above the intermediate transfer belt. In this way, residual toner having a positive charge is recovered to the photosensitive drum 2 in the primary transfer portion. At the same time, a toner image on the photosensitive drum 2 is primarily transferred.

In the primary transfer portion, since toner deposited on the photosensitive drum 2 is negatively charged, a force towards the intermediate transfer belt 16 is exerted on the toner. In contrast, since residual toner remaining after secondary transfer is positively charged, a force for returning to the photosensitive drum 2 is exerted on the residual toner. Accordingly, a simultaneous transfer and cleaning process may be executed. In this manner, residual toner remaining after secondary transfer may be recovered to the cleaning blade 71 of the photosensitive drum 2 via the photosensitive drum 2. Therefore, the need for a waste toner container disposed above the intermediate transfer belt 16 may be eliminated. As described above, since residual toner remaining after transfer may be recovered using a relatively simplified structure and the need for a waste toner container may be eliminated, the image forming apparatus may be easily made compact.

Such a method described below is referred to as a "simultaneous transfer and cleaning method". In addition, a belt charging unit 60 for residual toner remaining after secondary transfer is referred to as a "belt charging unit 60". Furthermore, if a charging roller is used as a belt charging unit, the belt charging unit is referred to as a "belt charging roller 63". The belt charging roller 63 is disposed downstream of the secondary transfer portion and upstream of the primary transfer portion in a direction in which the intermediate transfer belt rotates. According to the fourth embodiment, the belt charging unit 60 includes the belt charging roller 63 for charging residual toner remaining on the intermediate transfer belt 16 after secondary transfer to a polarity that is opposite to that of the charged toner and a high voltage power supply for applying a bias to the belt charging roller 63. In order to more effectively perform simultaneous transfer and cleaning, a slide member that slides along the intermediate transfer belt 16 and blocks deposition on the intermediate transfer belt 16 may be provided upstream of the belt charging roller 63 in a direction in which the intermediate transfer belt 16 moves. It is desirable that the slide member be in the form of a brush made from fibers having resistance to abrasion.

Each of the secondary transfer roller 90 and the belt charging unit 60 has a contact/noncontact control mechanism (not shown). Thus, at any timing, each the secondary transfer roller 90 and the belt charging unit 60 may be brought into contact with the intermediate transfer belt 16 and may be moved away from the intermediate transfer belt 16.

Figure 8:
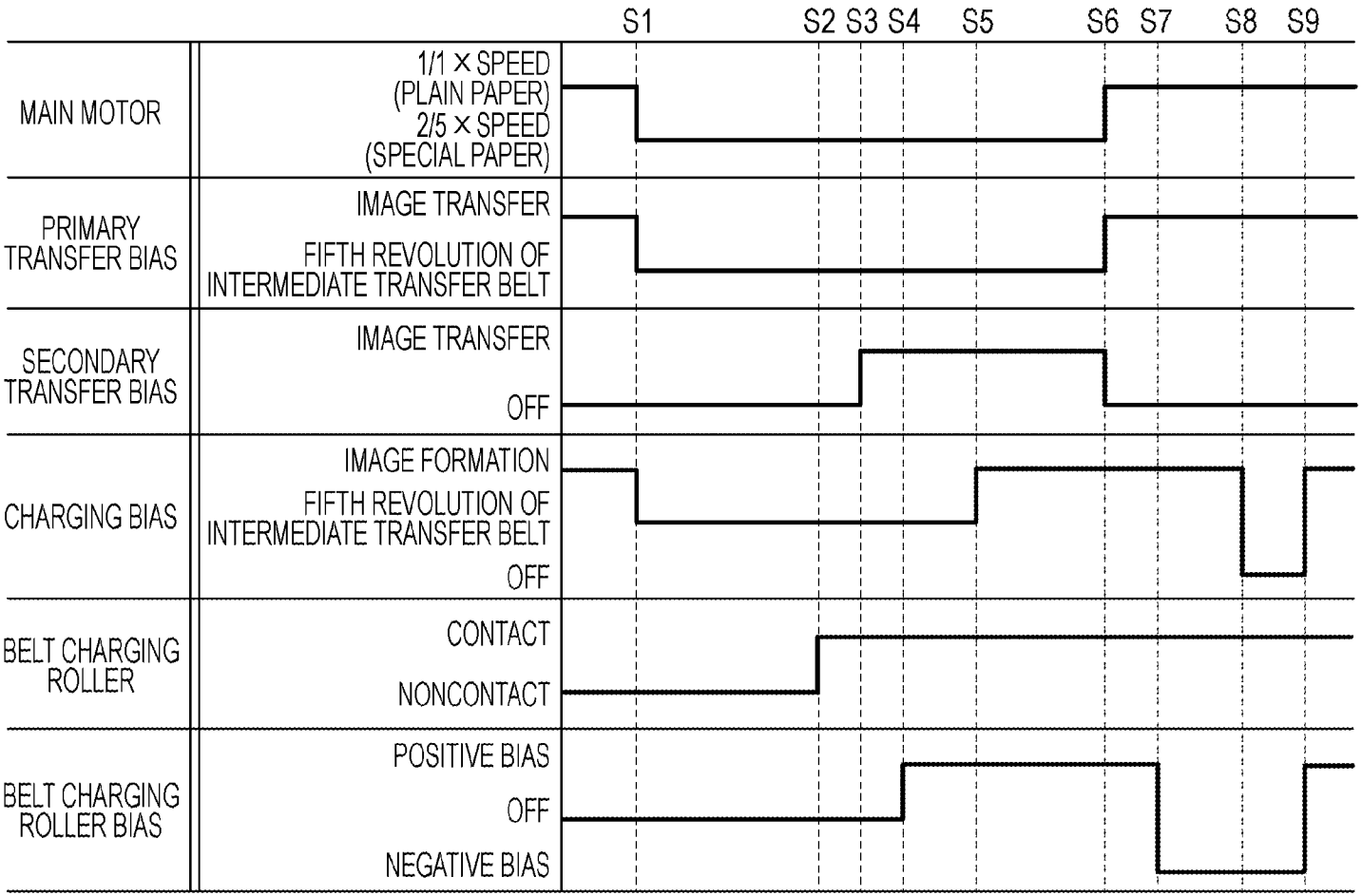
FIG. 8 is a timing diagram of bias application during a fifth revolution of the intermediate transfer belt according to the fourth embodiment.

The image forming operation according to the present embodiment is described next. The photosensitive drum 2 is rotated in a direction indicated by an arrow α shown in FIG. 6 (a counterclockwise direction) in synchronization with the rotation of the intermediate transfer belt 16 first. At that time, the secondary transfer roller 90 is not in contact with the intermediate transfer belt 16, and the belt charging unit 60 is not in contact with the intermediate transfer belt 16. Subsequently, like the first embodiment, an image forming process and primary transfer are performed. After the image forming processes for yellow, magenta, cyan, and black have been performed and primary transfer has been performed, an operation of the intermediate transfer belt 16 in a fifth revolution is performed before secondary transfer is started. A timing diagram starting from image formation using a simultaneous transfer and cleaning method is illustrated in FIG. 8. Like the first embodiment, at a time S1, primary transfer for black in a fourth station is completed.

When a simultaneous transfer and cleaning method is employed, like the first embodiment, after the time S1, a desired charging bias and a desired primary transfer bias are applied in the fifth revolution. Before secondary transfer is started, the secondary transfer roller 90 and the belt charging roller 63 are brought into contact with the intermediate transfer belt 16 (S2). This operation is performed immediately before the leading edge of an image on the intermediate transfer belt 16 in the fifth revolution reaches the secondary transfer portion.

Subsequently, in order to perform secondary transfer, a secondary transfer bias is applied and secondary transfer is performed (S3). After the secondary transfer has been completed, residual toner remaining on the intermediate transfer belt 16 after secondary transfer is positively charged by the belt charging roller 63 (S4). Thereafter, the residual toner having a positive charge reaches the photosensitive drum 2 (the primary transfer portion) with the movement of the intermediate transfer belt 16. At that time, it is required that the surface of the photosensitive drum 2 that is charged by the charging roller 3 and that is to be in contact with the primary transfer portion reaches the primary transfer portion. The charging bias is the same as the bias for image formation and is used for negatively charging the surface of the photosensitive drum 2. This is to generate an electric field so that the residual toner positively charged in the primary transfer portion is moved to the photosensitive drum 2. As described above, when the toner on the belt in the fifth revolution reaches the charging unit, such a bias that the charging roller 3 does not discharge is used. Accordingly, at a predetermined point in time, a bias for performing simultaneous transfer and cleaning is applied to the charging roller 3 (S5).

According to the fourth embodiment, the distance between the charging roller 3 disposed on the photosensitive drum 2 and the primary transfer portion is set to 57 mm. Accordingly, after application of a negative charging bias has been started, at least 57 mm of the surface of the photosensitive drum 2 that is not negatively charged passes through the primary transfer portion. If the residual toner reaches the primary transfer portion when such an area of 57 mm is present in the primary transfer portion, the primary transfer contrast is decreased. Thus, it is difficult to efficiently recover the residual toner remaining after secondary transfer onto the photosensitive drum 2. Therefore, in order to recover the residual toner, the time S5 at which the charging bias is applied is prior to the time the leading edge of a toner image remaining on the belt after secondary transfer reaches the primary transfer portion.

Figure 7:
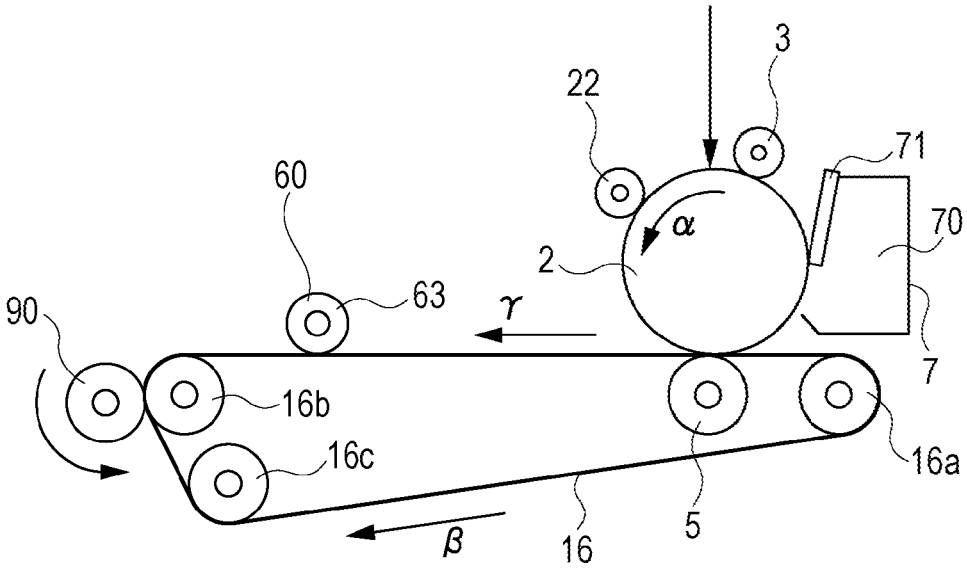
FIG. 7 is a schematic cross-sectional view of an image forming apparatus according to a fourth embodiment of the present invention.

In FIG. 7, the distance between the belt charging unit 60 and the primary transfer portion in the Y direction is 132 mm (note that the Y direction is a direction that is opposite to the direction indicated by the arrow β). Accordingly, a distance by which the residual toner that is positively charged is moved by the belt charging unit 60 until the residual toner reaches the primary transfer portion is 132 mm. The time taken to cover the distance is about 1.2 seconds. It is needed that the surface of the photosensitive drum 2 be negatively charged when the residual toner reaches the primary transfer portion. To determine the point in time at which the bias applied to the charging roller 3 is changed, a distance of 57 mm between the charging roller 3 and the primary transfer portion, which is about 0.5 seconds, needs to be taken into account. Accordingly, it is desirable that the charging bias be changed to such a bias that the photosensitive drum 2 is negatively charged after about 0.7 seconds have elapsed since the toner that was positively charged by the belt charging roller 63 passed beyond the position of the belt charging roller 63.

In addition, the design is such that, when the charging bias is applied and the surface of the photosensitive drum 2 that is negatively charged reaches the primary transfer portion, the trailing edge of the toner image on the intermediate transfer belt 16 has already passed beyond the primary transfer portion.

When secondary transfer is completed, the speed of the intermediate transfer belt is changed by the main motor from the speed for special paper (2/5x) to the speed for plain paper (1/1x). In addition, the primary transfer bias is changed back to the bias for image formation, and the secondary transfer bias is turned off (S6).

After the secondary transfer has been completed, the belt charging roller 63 for positively charging the residual toner has recovered negatively charged toner (residual toner). In order to remove the toner from the belt charging roller 63, the bias applied to the belt charging roller is switched from a positive bias to a negative bias (S7). In order to efficiently recover the residual toner that is negatively charged after the time S7, it is desirable that when the residual toner that is negatively charged reaches the primary transfer portion, the surface potential of the photosensitive drum 2 be close to zero. Therefore, the applied charging bias is turned off at a time S8. In order to determine the time S8, a period of time between when the toner is removed from the belt charging roller 63 to when the toner reaches the primary transfer portion (about 1.2 seconds) and a period of time between when the bias of the charging roller 3 is switched to when the surface of the photosensitive drum 2 reaches the primary transfer portion (about 0.5 seconds) needs to be taken into account. That is, the charging bias needs to be turned off at some time within about 0.7 seconds (=about 1.2 second–about 0.5 seconds) from the time the toner is removed from the belt charging roller 63. However, when the residual toner is removed using a negative bias, some toner does not move to the photosensitive drum 2 and still remains. Therefore, the toner that was not recovered is positively charged by the belt charging roller 63 again. Accordingly, the bias applied to the belt charging roller 63 is changed from a negative bias to a positive bias (S9). At that time, in order to efficiently recover the residual toner remaining after secondary transfer, a negative bias is applied to the charging roller again so that the photosensitive drum 2 is negatively charged. In a similar manner as determination of the time S5, the charging bias is applied again at some time within about 0.7 seconds from the time the bias applied to the belt charging roller 63 is switched from a negative bias to a positive bias. After this operation has been completed, an ICL cleaning operation for simultaneous transfer and cleaning is completed.

Others

While above embodiments have been described with reference to the image forming apparatus of a rotary type in which a plurality of developing units sequentially face the photosensitive drum 2 using the rotary 102 and performs development, the embodiments are also applicable to an image forming apparatus of a tandem type in which toner images are formed on a plurality of the photosensitive drums 2 and are sequentially transferred onto the intermediate transfer belt 16. In the case of an image forming apparatus of a tandem type, if the length of a toner image in a conveying direction is larger than a distance between the primary transfer portion and the secondary transfer portion of the photosensitive drum 2 disposed most downstream of the intermediate transfer belt 16, secondary transfer is not performed with the toner image being on the drum, and the intermediate transfer belt is rotated once more.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-185089 filed Aug. 20, 2010, which is hereby incorporated by reference herein in its entirety.

What is claimed is:

1. An image forming apparatus comprising:

a rotatable image bearing member configured to bear a toner image;

a charging member configured to charge the image bearing member;

an intermediate transfer member onto which the toner image formed on the image bearing member is transferred;

a primary transfer unit configured to primarily transfer the toner image that the image bearing member bears to the intermediate transfer member in a primary transfer portion;

a secondary transfer unit configured to secondarily transfer the toner image transferred onto the intermediate transfer member onto a transfer object in a secondary transfer portion; and a control unit;

wherein a mode in which the toner image formed on the intermediate transfer member passes through the primary transfer portion without a toner image being transferred from the image bearing member onto the intermediate transfer member is provided, and wherein in the mode, an area of the image bearing member that passes through the primary transfer portion while the toner image is passing through the primary transfer portion is defined as a first area, and wherein the control unit controls a voltage applied to the charging member so that electrical discharge does not occur between the image bearing member and the charging member when the first area reaches a position of the charging member, and wherein an absolute value of the voltage applied to the charging member when the first area reaches the position of the charging member is lower than an absolute value of the potential of the image bearing member.

2. The image forming apparatus according to claim 1, wherein when the first area reaches the position of the charging member, a voltage is not applied to the charging member.

3. The image forming apparatus according to claim 1, further comprising:

a mode selection unit configured to allow a user to select the mode.

4. The image forming apparatus according to claim 1, further comprising:

a transfer object detecting unit configured to detect a type of transfer object;

wherein the mode is selected in accordance with a result of detection performed by the transfer object detecting unit.

5. The image forming apparatus according to claim 4, wherein if it is determined from a result of detection performed by the transfer object detecting unit that the transfer object is a heavy paper sheet, the mode is selected.

6. The image forming apparatus according to claim 1, further comprising:

a toner charging member disposed downstream of the secondary transfer portion and upstream of the primary transfer portion in a rotational direction of the intermediate transfer member, the toner charging member charging toner deposited on the intermediate transfer member;

wherein in the mode, the toner image that has passed through the primary transfer portion is transferred onto a transfer object by the secondary transfer unit, and wherein a voltage having a polarity that is opposite to a polarity of charge of the toner is applied to the toner charging member, and the toner charging member charges the toner subjected to secondary transfer, and wherein the toner charged by the toner charging member moves to the image bearing member in the primary transfer portion, and the toner is recovered by a cleaning unit of the image bearing member, and wherein the control unit changes the voltage applied to the charging member from a voltage that does not cause electrical discharge to a voltage that causes the charging member to have charge of a polarity that is same as the polarity of the charge of the toner so that an area of the image bearing member that is charged by the charging member so as to have a polarity that is same as the polarity of the charge of the toner reaches the primary transfer portion before a leading edge of the toner charged by the toner charging member reaches the primary transfer portion.

* * * * *